US008517326B2

(12) United States Patent
Kelley

(10) Patent No.: US 8,517,326 B2
(45) Date of Patent: Aug. 27, 2013

(54) MOUNTING SYSTEM FOR AN AIR HANDLING UNIT

(76) Inventor: Howard Kelley, Westminster, SC (US)

( * ) Notice: Subject to any disclaimer, the term of this patent is extended or adjusted under 35 U.S.C. 154(b) by 148 days.

(21) Appl. No.: 13/068,438

(22) Filed: May 11, 2011

(65) Prior Publication Data

US 2011/0278427 A1 Nov. 17, 2011

Related U.S. Application Data

(60) Provisional application No. 61/395,248, filed on May 11, 2010.

(51) Int. Cl.
*B42F 13/00* (2006.01)

(52) U.S. Cl.
USPC ..... 248/343; 52/506.06; 52/39

(58) Field of Classification Search
USPC ..... 248/637, 678, 610, 674, 317, 323, 248/326, 327, 339, 343, 200.1, 235, 241, 248/295.11, 297.31; 62/295, 297; 52/506.06, 52/39, 702, 712, 506.07, 715
See application file for complete search history.

(56) References Cited

U.S. PATENT DOCUMENTS

| | | | | | |
|---|---|---|---|---|---|
| 1,779,564 | A | * | 10/1930 | Slagel | 248/318 |
| 3,256,664 | A | * | 6/1966 | Brunnzell | 52/478 |
| 3,721,484 | A | * | 3/1973 | Macioge et al. | 312/245 |
| 3,735,951 | A | * | 5/1973 | Reed | 248/340 |
| 4,513,939 | A | | 4/1985 | Berger et al. | |
| RE33,147 | E | * | 1/1990 | Reiker | 248/200.1 |
| 4,957,185 | A | * | 9/1990 | Courchesne et al. | 182/150 |
| 5,011,028 | A | * | 4/1991 | Sweeney | 211/60.1 |
| 5,039,039 | A | * | 8/1991 | Schaffer | 248/59 |
| 5,064,161 | A | * | 11/1991 | Anderson | 248/317 |
| 5,397,090 | A | * | 3/1995 | Carson et al. | 248/327 |
| 5,533,697 | A | * | 7/1996 | Fletcher et al. | 248/146 |
| 5,758,465 | A | * | 6/1998 | Logue | 52/506.06 |
| 6,311,626 | B1 | * | 11/2001 | Roberts | 108/42 |
| 6,729,096 | B1 | * | 5/2004 | Ashmore et al. | 52/506.06 |
| 6,935,600 | B1 | * | 8/2005 | Barrepski | 248/317 |
| 7,128,302 | B2 | | 10/2006 | Dubensky et al. | |
| 7,152,535 | B2 | * | 12/2006 | Mikich et al. | 108/42 |
| 7,228,669 | B1 | * | 6/2007 | Yaraschefski | 52/506.06 |
| 7,293,394 | B2 | * | 11/2007 | Davis | 52/838 |
| 7,430,835 | B1 | | 10/2008 | Larson | |
| 7,575,213 | B2 | * | 8/2009 | Rausch | 248/317 |
| 7,617,649 | B2 | * | 11/2009 | Arakawa | 52/506.06 |
| 7,793,908 | B1 | * | 9/2010 | Finegan, Jr. | 248/317 |
| 7,810,438 | B2 | * | 10/2010 | Ryberg | 108/42 |
| 7,980,523 | B2 | * | 7/2011 | O'Neil et al. | 248/317 |
| 8,250,827 | B2 | * | 8/2012 | Lin et al. | 52/702 |
| 2005/0115861 | A1 | * | 6/2005 | Copeland | 206/527 |
| 2007/0145222 | A1 | * | 6/2007 | Rausch | 248/317 |
| 2009/0100796 | A1 | * | 4/2009 | Denn et al. | 52/849 |
| 2010/0101167 | A1 | * | 4/2010 | Morey | 52/506.06 |
| 2012/0180288 | A1 | * | 7/2012 | Crowley | 29/428 |
| 2012/0181240 | A1 | * | 7/2012 | Crowley | 211/26 |

* cited by examiner

*Primary Examiner* — Nkeisha Smith
(74) *Attorney, Agent, or Firm* — Rodgers & Rodgers

(57) ABSTRACT

A mounting system for an air handling unit comprising four elongated rods attached at the upper ends to floor joists and at the lower ends to a pair of elongated supports disposed below the air handling unit whereby the rods are adjustable to allow for tilting of the air handling unit to prevent accumulation of moisture.

5 Claims, 4 Drawing Sheets

MOUNTING SYSTEM FOR AN AIR HANDLING UNIT

The benefits under 35 U.S.C. 119 are claimed of provisional patent application 61/395,248 filed May 11, 2010.

BACKGROUND OF THE INVENTION

Most residential and commercial buildings utilize air handling units for the purpose of enclosing heating, ventilation and air-conditioning equipment (HVAC). Air handling units are typically hung in basements or attics and function to circulate heated or cooled air throughout the building. Usually air handling units are installed with little or no attention to the need for proper drainage of moisture which inherently accumulates in the unit. This accumulation of moisture ultimately results in the growth of mold in the unit which naturally worsens over time if it doesn't receive prompt attention. Without proper removal, the mold and mildew will cause undesirable and adverse effects on the health of the occupants of the building.

BRIEF SUMMARY OF THE INVENTION

By this invention, a mounting system for an air handling unit includes four elongated rods attached at the upper ends thereof to floor joists by means of adjustable fastener assemblies. Two of the rods are attached, respectively, to a pair elongated supports disposed below the air handling unit by means of angular support assemblies.

DETAILED DESCRIPTION OF THE INVENTION

Figure 1:
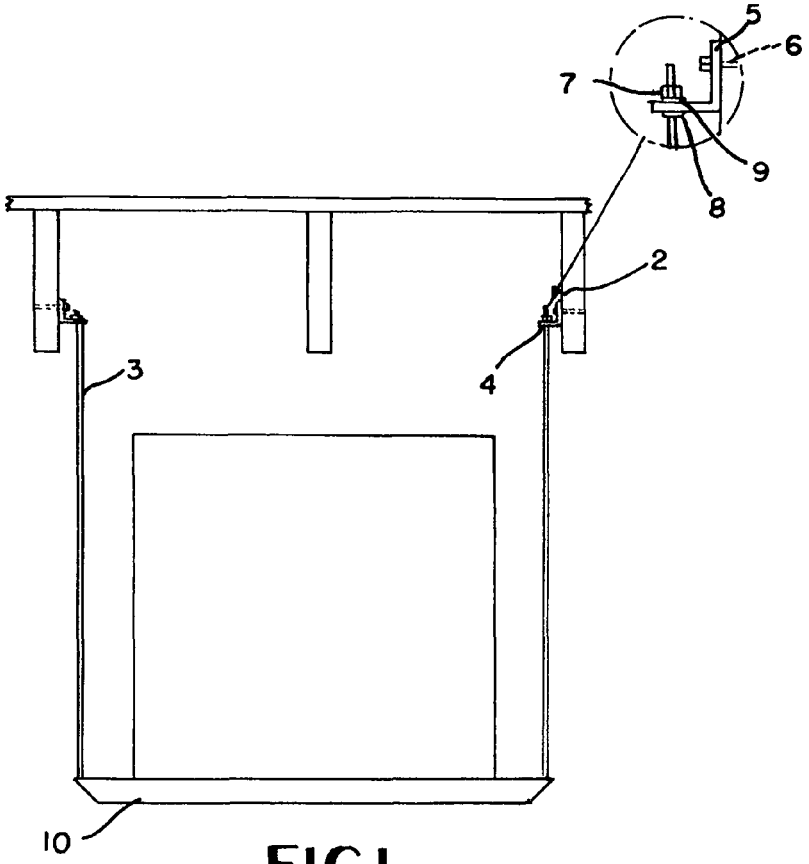
FIG. 1 is an end view of one embodiment the air handling unit mounting system according to this invention.

In the drawings, the numeral 1 designates an air handling unit which is attachable to floor joists 2 by means of four elongated rods 3 which are attached, respectively, to floor joists 2 by means of fastener assemblies 4. Details of fastener assemblies 4 include angle bracket 5, screw 6, lock nut 7, washer 8 and rubber grommet 9. Adjustment of lock nut 7 allows for the raising or lowering of air handling unit. Further, rods 3 are attached at their lower ends to a pair of spaced elongated angular supports 10 by means of support assemblies 11. To facilitate the assembly operation, the ends of elongated supports 10 extend beyond the vertical walls of air handling unit 1. Support assemblies 11 include lock nut 12, washer 13 and rubber grommet 14. Also, to prevent slippage, cork strip 15 extends substantially the length of elongated support 10.

Figure 2:
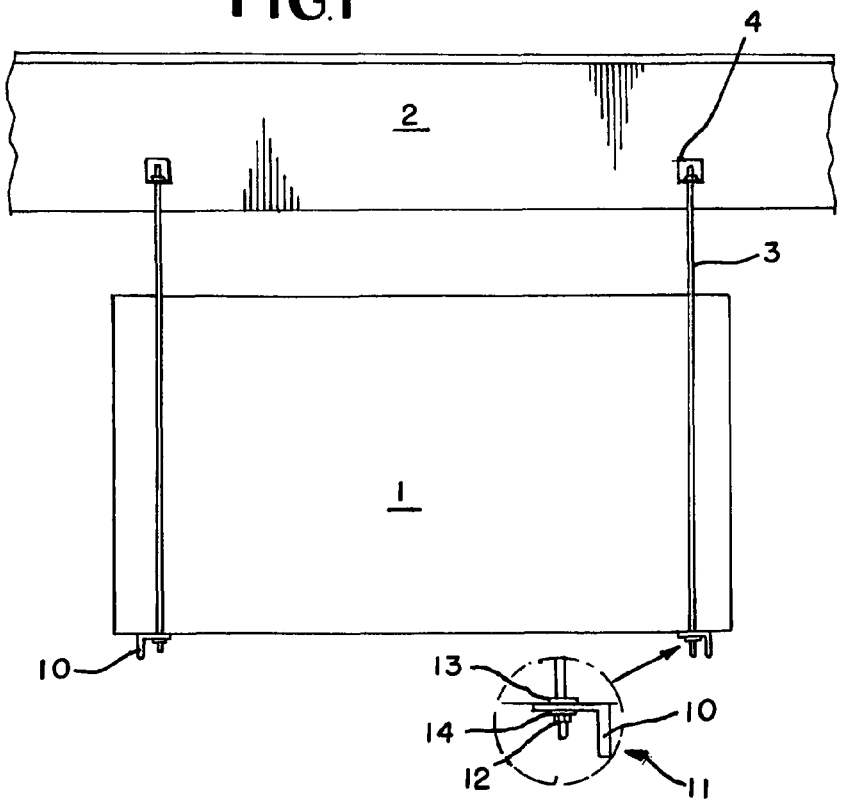
FIG. 2 is a side view of the system.
Figure 3:
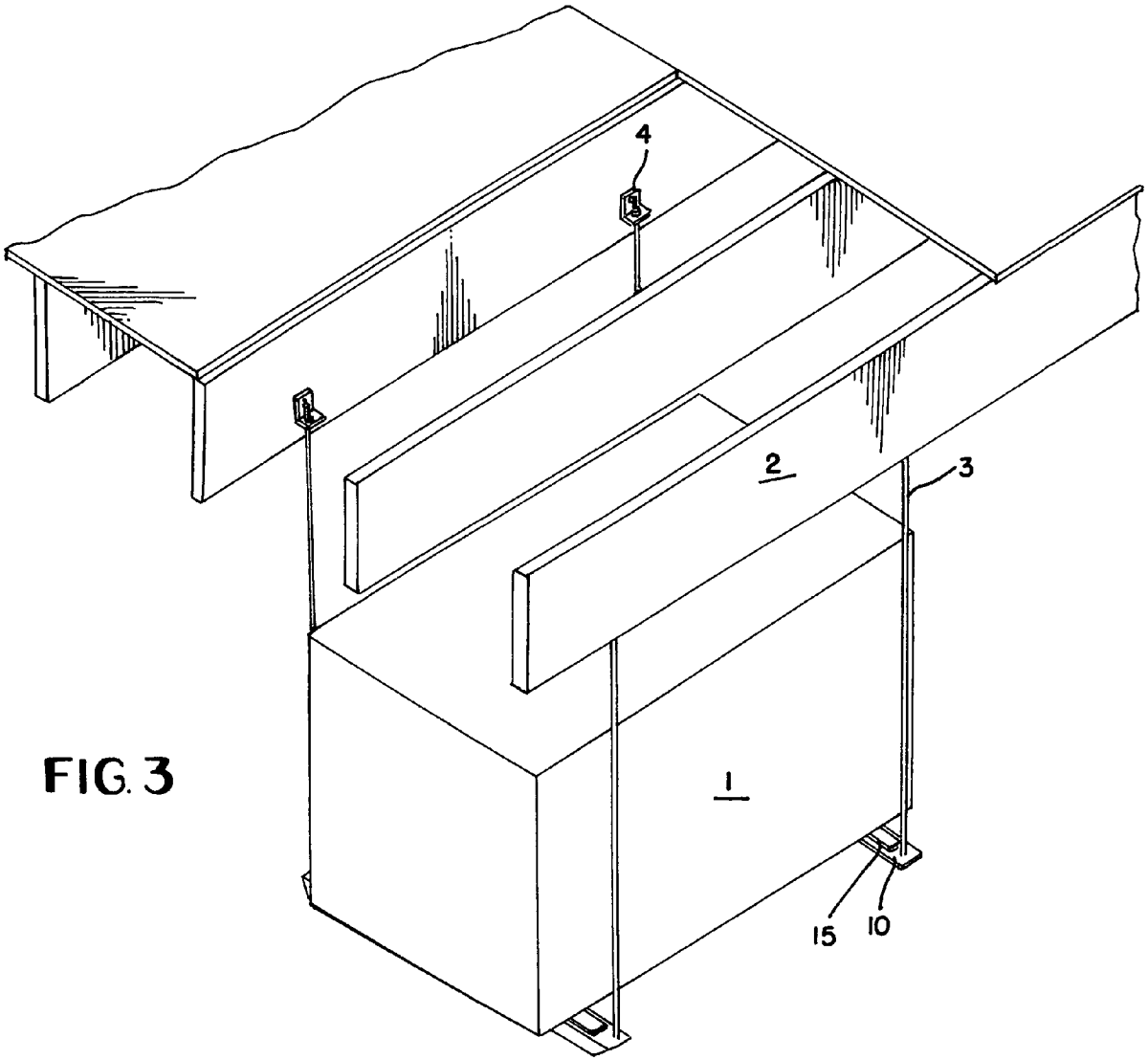
FIG. 3 is a perspective view of the system.
Figure 4:
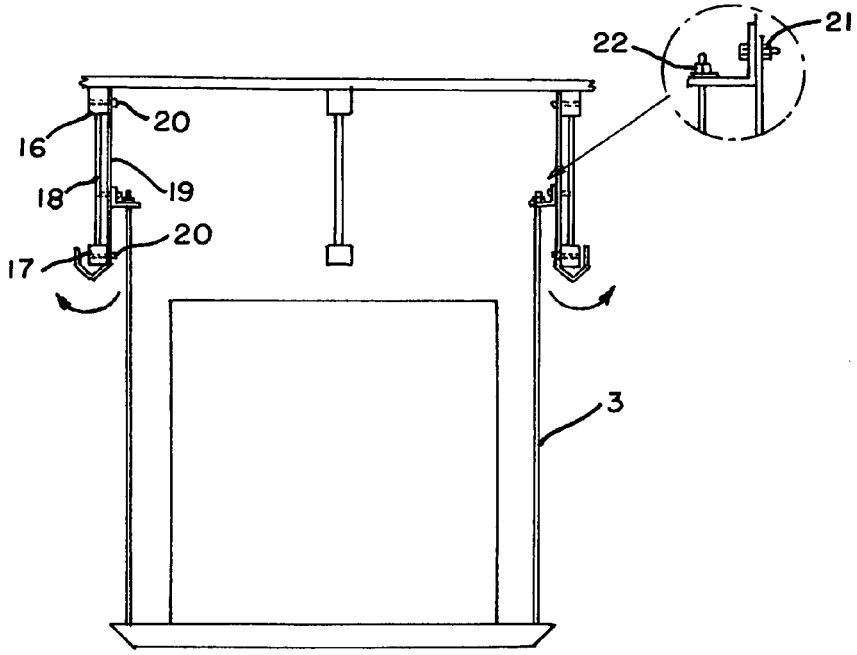
FIGS. 4, 5 and 6 are views similar to FIGS. 1, 2 and 3, respectively, and show a modification of the invention.
Figure 5:
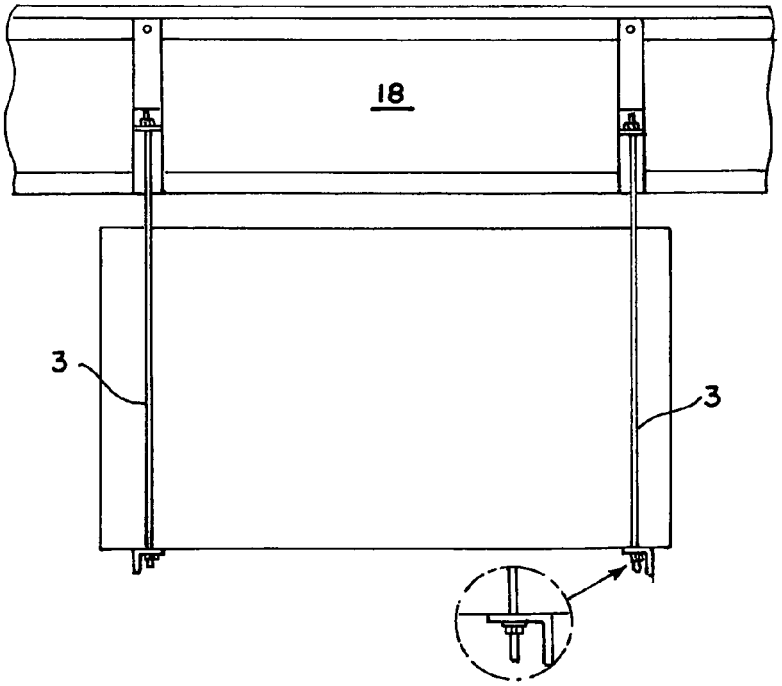
Figure 6:
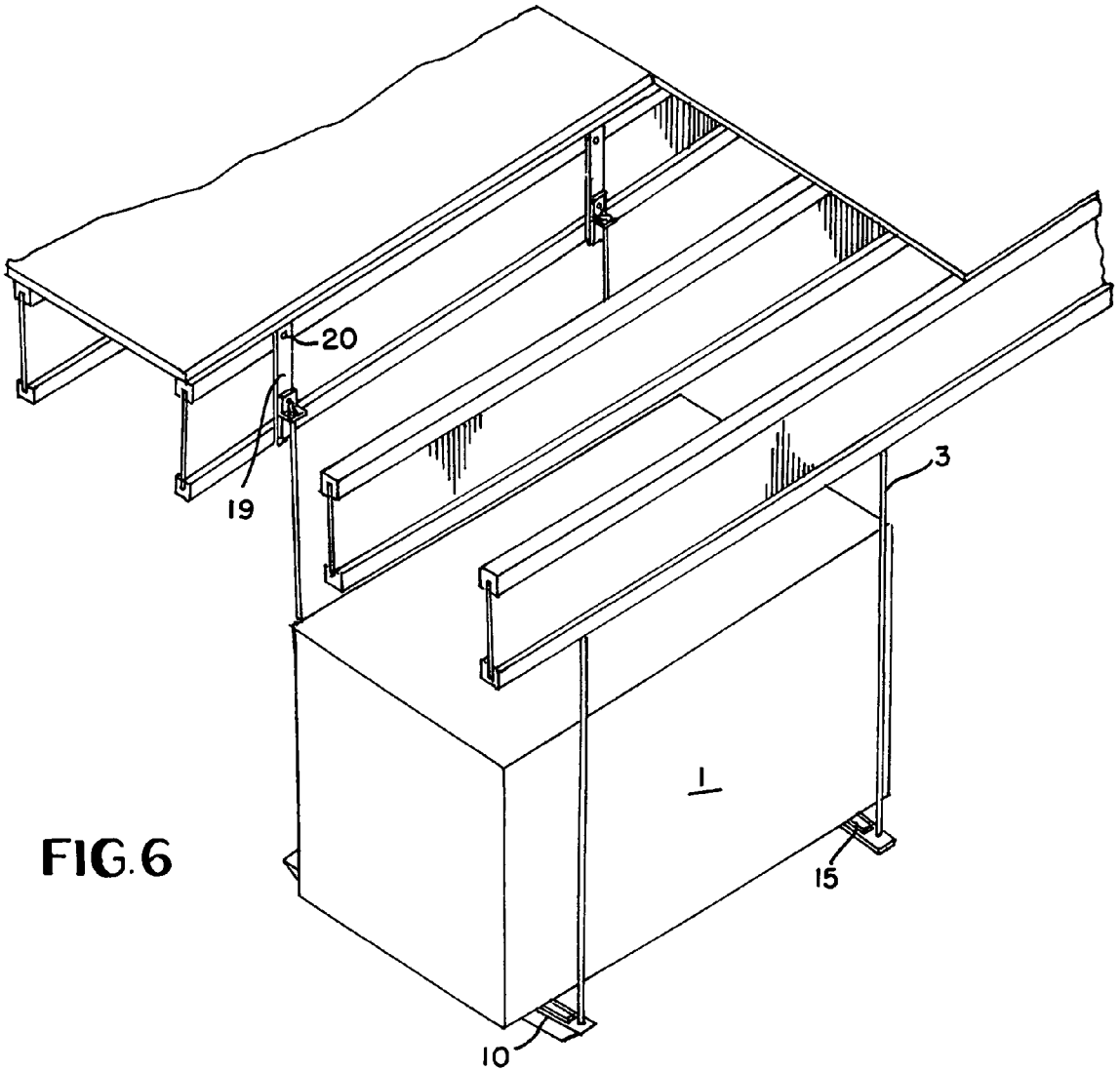

The mounting system, as shown in FIGS. 4, 5 and 6, is essentially the same as that shown in FIGS. 1, 2 and 3 and is for use in a tongue and groove integrated (TGI) floor system. A TGI floor system embodies a pair of spaced 2×3 boards 16 and 17 interconnected by a sheet of plywood 18 by means of a tongue and groove connection. The TGI is used mostly in multi-story buildings requiring the support of heavy loads. By this invention, brackets 19 are attached by means of self tapping screws 20 to top and bottom boards 16 and 17 of the floor system. If brackets 19 are only attached to lower board 17, the weight of the air handling unit would cause the screw to pull away from the board. By attaching brackets 19 to both boards 16 and 17, the air handling unit is secured in place and won't become detached. Rods 3 are attached to brackets 19 by means of fastener assemblies including bolt and lock nut combination 21 together with lock nut, washer and rubber grommet combination 22. Manipulation of lock nut combination 22 allows for vertical adjustment of rods 3.

Once the hanging system is installed with air handling unit 1 in position, and as shown in FIGS. 3 and 6, air handling unit 1 is adjustable front to rear by the manipulation of rods 3 and the associated fastener means to tilt the air handling unit to the proper position so that moisture which normally collects in the unit is allowed to condense and flow away from the unit without accumulating within the unit itself. The front and rear of the air handling unit is adjusted by means of a leveling instrument so the instrument reflects a one-half bubble slope of the unit toward the drain side of the evaporator. By this means, mold and mildew does not accumulate because of improper installation of the unit which prevents the dissipation of moisture from the condensate drain.

The buildup of mold and mildew causes a health hazard to inhabitants who breathe air which is processed through the evaporator element of the air handling unit. It has been proposed that governmental codes and regulations be amended to incorporate proper air handling unit installation systems and methods in order to eliminate the problem of mold and mildew accumulation.

The invention claimed is:

1. A mounting system comprising an air handling unit, four elongated rods having spaced upper and lower ends, said upper ends attached to floor joists, said air handling unit having spaced vertical walls, two of said rods attached at said lower ends to a first elongated support, the other two of said rods attached at said lower ends to a second elongated support, said first and second elongated supports having spaced ends, the ends of said supports extending beyond said vertical walls of the air handling unit, said elongated rods being vertically adjustable by means of fastener assemblies, each of said fastener assemblies comprising an angle bracket having interconnected vertical and horizontal elements, said vertical elements attached to a respective joist, each of said upper ends extending through a respective horizontal element and interconnected to said horizontal element by a lock nut threadably interconnected to each of said upper ends, and a pair of frictional strips substantially coextensive with said elongated supports and interposed respectively between said air handling unit and said elongated supports.

2. A mounting system according to claim 1 wherein said frictional strips are cork.

3. A mounting system according to claim 1 wherein said joists comprise a pair of spaced boards interconnected by a tongue and groove connecting planar board, a bracket interconnects said spaced boards and is substantially coextensive with said planar board, and at least one of said rods is interconnected to said bracket by means of an adjustable fastener assembly.

4. A mounting system according to claim 1 wherein said elongated supports are angular.

5. A mounting system according to claim 1 wherein a rubber grommet is interposed between said, each of lock nut and said horizontal element.

* * * * *